US008042339B2

(12) United States Patent
Lacy et al.

(10) Patent No.: US 8,042,339 B2
(45) Date of Patent: Oct. 25, 2011

(54) LEAN DIRECT INJECTION COMBUSTION SYSTEM

(75) Inventors: Benjamin Lacy, Greenville, SC (US); Balachandar Varatharajan, Clifton Park, NY (US); Willy Steve Ziminsky, Greenville, SC (US); Gilbert O. Kraemer, Greer, SC (US); Gregory Allen Boardman, Greer, SC (US); Ertan Yilmaz, Niskayuna, NY (US); Patrick Melton, Horse Shoe, NC (US)

(73) Assignee: General Electric Company, Schenectady, NY (US)

( * ) Notice: Subject to any disclaimer, the term of this patent is extended or adjusted under 35 U.S.C. 154(b) by 847 days.

(21) Appl. No.: 12/073,939

(22) Filed: Mar. 12, 2008

(65) Prior Publication Data

US 2009/0229269 A1 Sep. 17, 2009

(51) Int. Cl.
*F02C 1/00* (2006.01)
*F02G 3/00* (2006.01)

(52) U.S. Cl. ..... 60/740; 60/737; 60/752; 60/804

(58) Field of Classification Search ..... 60/734, 60/737, 742, 740, 746, 747, 752, 804
See application file for complete search history.

(56) References Cited

U.S. PATENT DOCUMENTS

| | | | | |
|---|---|---|---|---|
| 5,361,586 | A * | 11/1994 | McWhirter et al. | 60/737 |
| 5,713,206 | A * | 2/1998 | McWhirter et al. | 60/747 |
| 6,298,667 | B1 * | 10/2001 | Glynn et al. | 60/737 |
| 6,536,216 | B2 * | 3/2003 | Halila et al. | 60/737 |
| 6,813,889 | B2 * | 11/2004 | Inoue et al. | 60/737 |
| 6,928,823 | B2 * | 8/2005 | Inoue et al. | 60/776 |
| 7,117,676 | B2 * | 10/2006 | Farhangi et al. | 60/736 |
| 7,140,184 | B2 * | 11/2006 | Sprouse et al. | 60/743 |
| 7,188,476 | B2 * | 3/2007 | Inoue et al. | 60/737 |
| 7,469,543 | B2 * | 12/2008 | Veninger | 60/723 |
| 7,469,544 | B2 * | 12/2008 | Farhangi | 60/740 |
| 7,810,333 | B2 | 10/2010 | Kraemer et al. | |
| 2004/0035114 | A1 * | 2/2004 | Hayashi et al. | 60/737 |
| 2010/0115954 | A1 * | 5/2010 | Nazeer et al. | 60/737 |
| 2010/0175380 | A1 * | 7/2010 | Davis et al. | 60/734 |
| 2011/0016871 | A1 * | 1/2011 | Kraemer et al. | 60/772 |

* cited by examiner

*Primary Examiner* — William Rodriguez
(74) *Attorney, Agent, or Firm* — Nixon & Vanderhye P.C.

(57) ABSTRACT

The present invention is directed to a lean direct injection (LDI) combustion system for a gas turbine using a shell and tube heat exchanger concept to construct a shell and tube lean direct injector ("LDI") for the combustion system. One side of the LDI injector, either the shell side or the tube side, carries an oxidizer, such as air, to the combustor, while the other side of the LDI injector carries fuel to the combustor. Straight or angled holes drilled in an end plate of the combustor allow the fuel to enter the combustor and mix with air being injected into the combustor.

20 Claims, 9 Drawing Sheets

LEAN DIRECT INJECTION COMBUSTION SYSTEM

The present invention is directed to gas turbines, and more particularly to a lean direct injection (LDI) combustion system using a shell and tube heat exchanger concept to carry fuel and air to the combustor.

BACKGROUND OF THE INVENTION

Most combustion processes have, in some way or another, a recirculating flow field. The recirculating flow field tends to stabilize the combustion reaction zone, but an unnecessarily large recirculation zone can result in high nitrogen oxide ($NO_x$) emissions for combustion systems.

Lean direct injection for combustion has been shown to have the potential to reduce $NO_x$ emissions. However, constructing a combustor to simply and uniformly inject many fuel and air streams presents a challenge. Non-premixed combustors typically use multiple fuel passages to inject fuel from a diffusion tip into air passing through an outer ring of the diffuser tip. This requires multiple diffuser tips with multiple separate air and fuel passages all mounted in a complicated head end assembly.

The shell and tube LDI combustion system of the present invention provides a means for easily constructing a combustion system made up of many LDI injector sets with uniform air and fuel flow through all the passages using a concept similar to a shell and tube heat exchanger design. A shell and tube heat exchanger consists of a shell with a bundle of tubes inside it. One fluid flows through the tubes and another fluid flows over the tubes, through the shell, to transfer heat between the two fluids.

BRIEF DESCRIPTION OF THE INVENTION

The present invention is directed to a lean direct injection (LDI) combustion system using a shell and tube heat exchanger concept to construct a shell and tube lean direct injector ("LDI") used with the combustion system. According to the present invention, one side of the LDI injector, either the shell or the tube, carries an oxidizer, such as air, to a combustor, while the other side of the LDI injector carries fuel to the combustor. The tubes carry the oxidizer (or fuel, or diluent or combinations thereof) to the combustor, while straight or angled holes drilled or otherwise cut into an end plate of the combustor allow the fuel (or oxidizer, or diluent or combinations thereof) to enter the combustor from the shell. Heat exchanger construction techniques, such as brazing or welding, are used to assemble the components of the LDI combustion system.

DETAILED DESCRIPTION OF THE INVENTION

Figure 1:
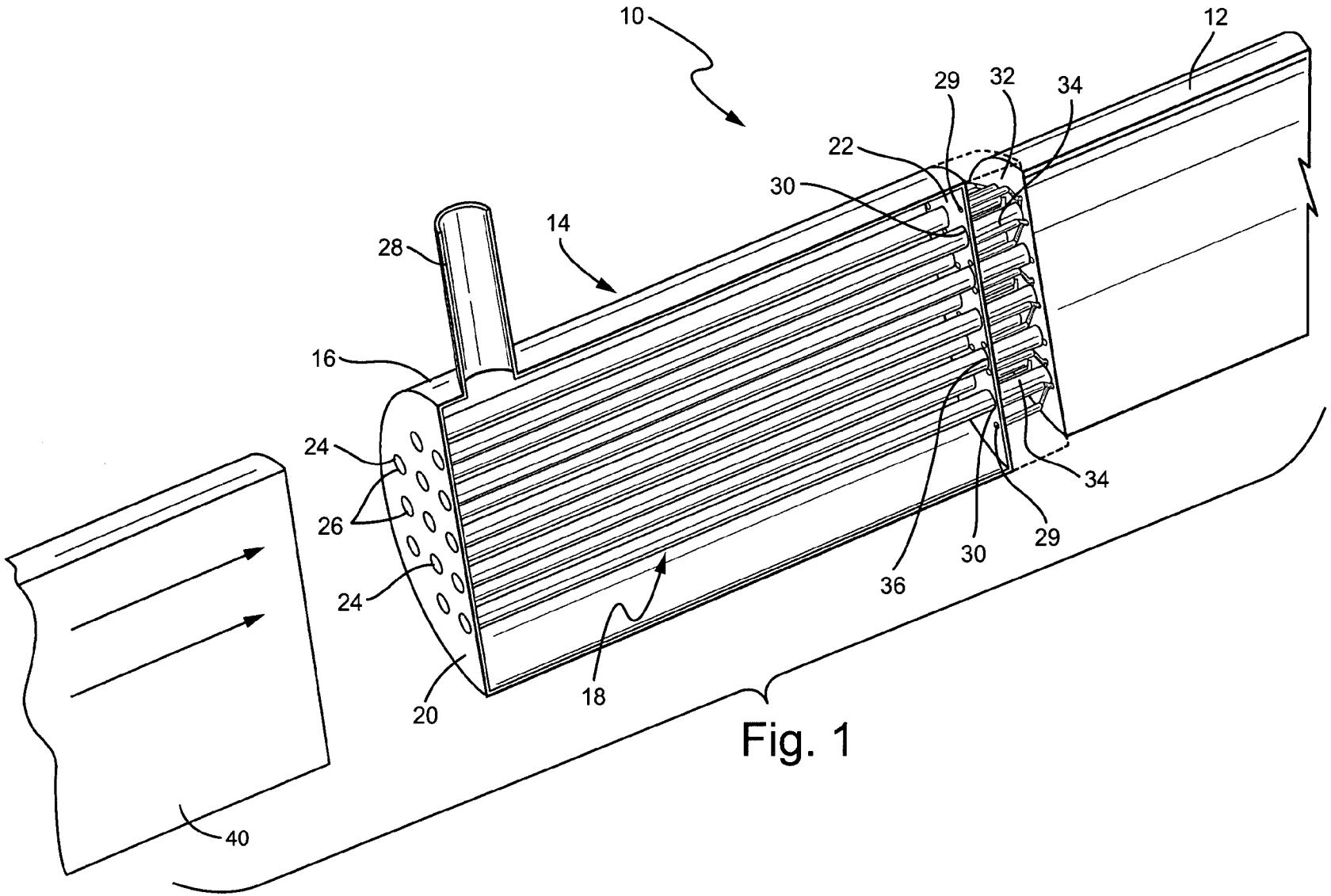
FIG. 1 is a partial cross-sectional, perspective view of one embodiment of the shell and tube lean direct injection combustion system of the present invention.

FIG. 1 is a partial cross-sectional, perspective view of one embodiment of the shell and tube lean direct injection combustion system 10 of the present invention. The shell and tube LDI combustion system 10 includes a combustor 12 and a shell and tube lean direct injector 14 that carries fuel and an oxidizer, such as air, to the combustor 12.

The shell and tube LDI 14 is comprised of a shell 16 and a bundle or plurality of tubes 18 positioned inside of the shell 16. In the embodiment of the LDI 14 shown in FIG. 1, the fuel is carried to the combustor 12 by the "shell side" 16 of LDI 14, while the air is carried to the combustor 12 by the "tube side" 18 of LDI 14. As an alternative, however, either side could contain fuel, air, or diluent, or any combination thereof.

Figure 2:
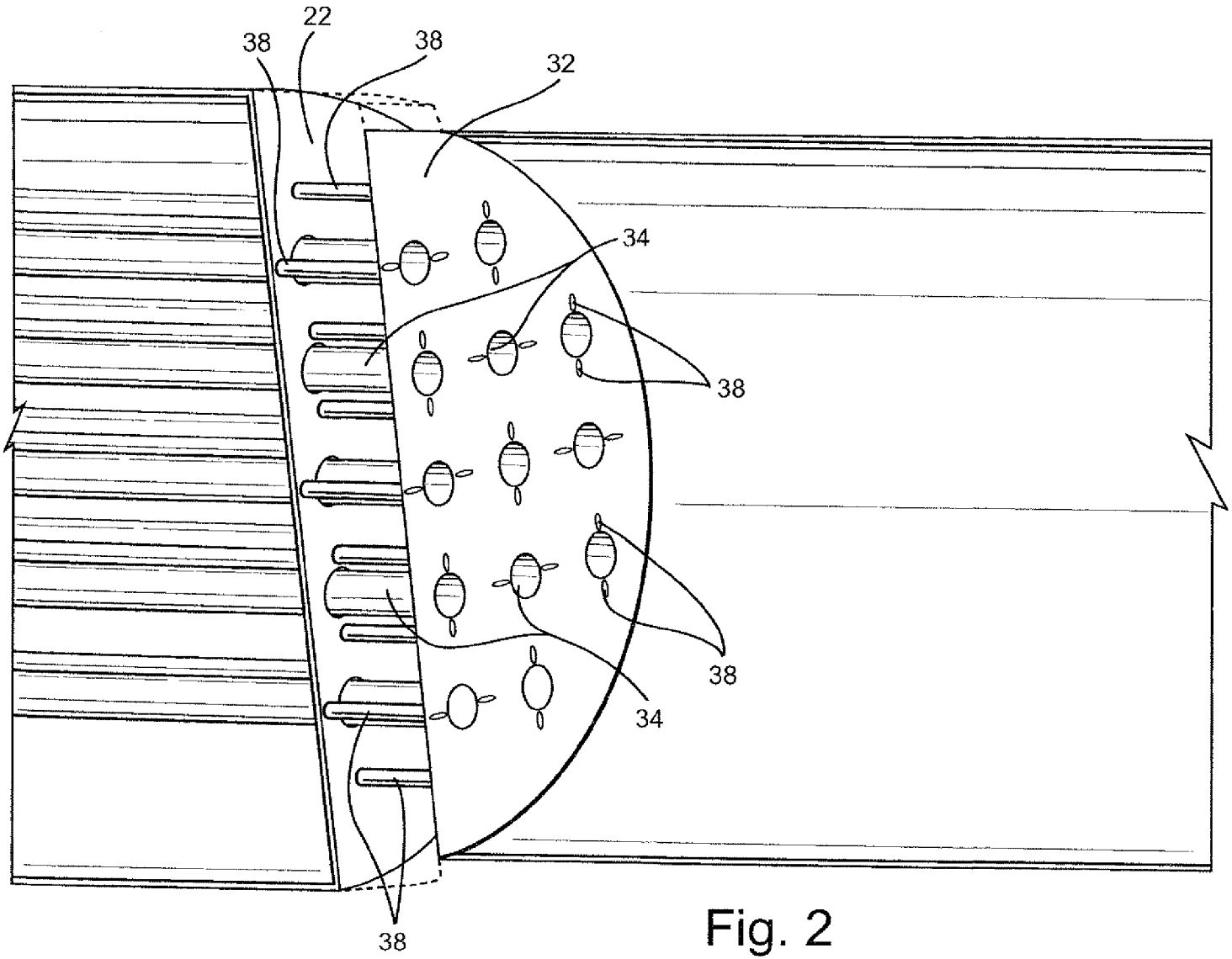
FIG. 2 is another partial cross-sectional, perspective view of the embodiment of the shell and tube lean direct injection combustion system of FIG. 1 showing holes in the end plate of the combustor for introducing fuel from the shell side and air from the tube side into the combustor.

FIG. 2 is another partial cross-sectional, perspective view of the embodiment of the shell and tube lean direct injection combustion system 10 of FIG. 1 showing two sets of holes in an end plate of the combustor 12 for injecting fuel from the shell side 16 and air from the tube side 18 into the combustor 12.

The plurality of tubes 18 within shell 16 extend completely across the interior of shell 16 from a first end plate 20 of shell 16 to a second end plate 22 of shell 16. The first end plate 20 has a plurality of holes 24 drilled or otherwise cut into it in which first ends 26 of tubes 18 terminate. The plurality of holes 24 in end plate 20 correspond in number to the plurality of tubes 18 within shell 16. The second end plate 22 of shell 16 also has a plurality of holes 30 drilled or otherwise cut into it in which second ends 36 of tubes 18 terminate.

Adjacent to end plate 22 of shell 16 is an end plate or cap 32 of combustor 12. End plate 32 is shown in phantom in FIGS. 1 and 2 so that holes within end plate 32 for injecting fuel and air into combustor 12 can be readily illustrated.

Air enters combustor 12 through the tube side 18 of LDI 14 of the embodiment of the combustion system 10 shown in FIGS. 1 and 2. As can be seen in FIGS. 1 and 2, a plurality of holes 34 are drilled or otherwise cut into end plate 32. Holes 34 correspond in number and positioning to holes 30 in end plate 22. As such, holes 34 are used to inject air into combustor 12. To this end, the first end plate 20 of shell 16 is joined to an upstream plenum 40 shown in FIG. 1. Air from upstream plenum 40 enters into holes 24 in end plate 20 and passes through tubes 18 into combustor 12 through holes 34 in end plate 32.

Fuel enters combustor 12 through the shell side 16 of LDI 14. The shell 16 includes a fuel inlet 28 through which fuel is pumped into shell 16. The end plate 22 of shell 16 also includes a plurality of fuel holes 29 corresponding to a plurality of fuel holes 38 in end plate 32 of combustor 12. The fuel flowing through fuel holes 29 and then fuel holes 38 is injected into combustor 12, where it is mixed with air injected into combustor 12 from air holes 34 connected to tubes 18. As can be seen from FIG. 2, for each air hole 34 in end plate 32 of combustor 12, there is preferably at least a pair of fuel holes 38 straddling it. The shell side 16, fuel inlet 28, fuel holes 29 in end plate 22 and fuel holes 38 through the end plate 32 have been sized to ensure uniform hole sizes throughout for proper fuel delivery to combustor 12.

The tubes 18 and shell 16 can be brazed or welded together. The air holes 34 and fuel holes 38 can be drilled or cut through end plate 32 using any conventional method. In the configuration shown in FIGS. 1 and 2, the fuel holes 38 start straight and then are angled at their exit in end plate 32 to inject fuel into the air stream coming from air holes 34. The fuel holes 38 are shown in FIG. 2 as exiting into the combustor 12, but they could be cut so as to intersect the air holes within end plate 32, thus providing some premixing of air and fuel prior to entry into the combustor 12. It should be noted that fuel and air holes 38 could also be cut either in line with the incoming tubes through end plate 32, or completely at an angle relative to the incoming tubes through end plate 32. It should be further noted that the number or location of fuel holes 38 positioned around an air hole 34 could be varied, based on optimizing performance of the combustion system 10.

Figure 2A:
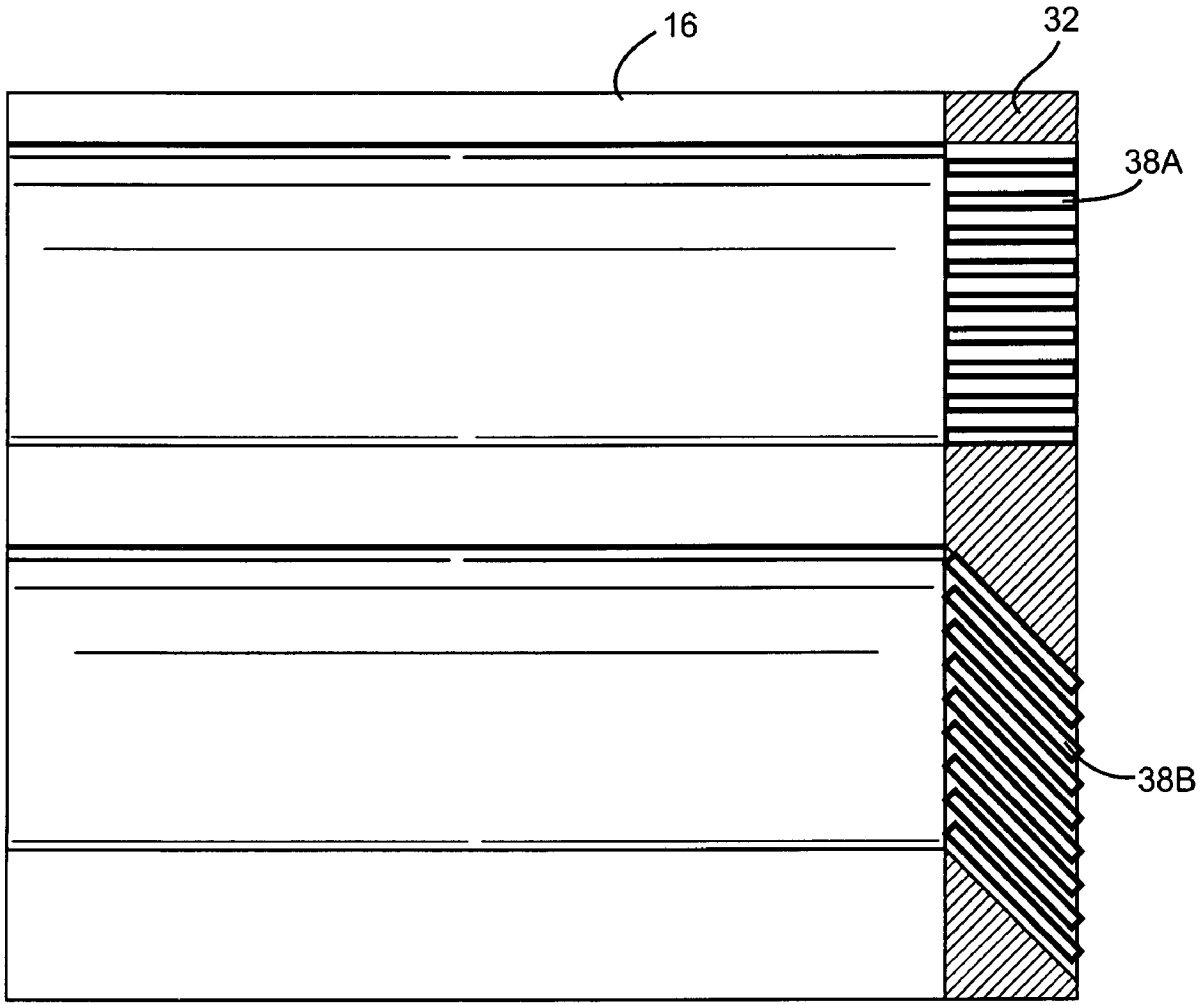
FIG. 2A is a cross-sectional schematic that shows two different methods for cutting fuel and air holes in the end of the combustor.

FIG. 2A is a cross-sectional schematic showing two different methods for cutting fuel and air holes in the end plate 32 of the combustor. The first method is to cut holes 38A that are straight through end plate 32, similar to those shown in FIG. 2. The second method is to cut the air and fuel holes 38B at an angle so as to angle the flow entering into the combustor. A combination of different angled tubes around the combustor can be used to impart swirl.

The shell side 16 of LDI 14 is sized to contain as many LDI injector tubes 18 as desired. The combustion system 10 could contain one large shell and tube LDI 14, such that the end plate 22 of the LDI 14 is the cap 32 of combustor 12, or the combustor 10 could contain a number of smaller shell and tube LDI's 14 mounted adjacent to each other in a pattern about the cap 32 of combustor 12.

In one alternative embodiment of combustion system 10, the fuel would be carried on the tube side 18 and the air carried on the shell side 16, such that air injects into fuel. Additionally, either the fuel or air side could have a premixed air/fuel mixture instead of using pure fuel or pure air so that mixing of the air and fuel in the combustor 12 is more rapid. The fuel side or the air side could also contain some combination of diluents as a way to introduce diluents into the combustor 12.

Figure 3:
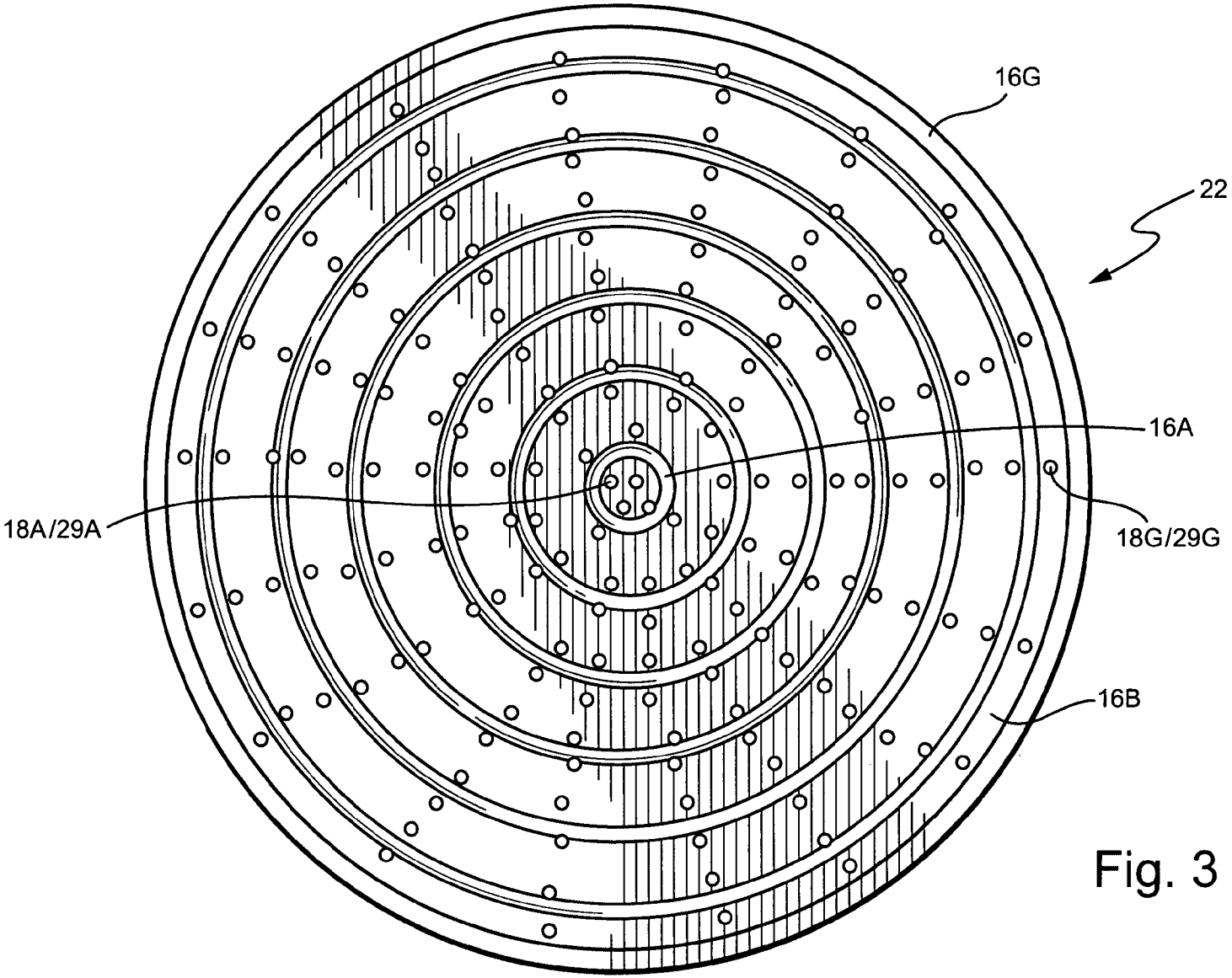
FIG. 3 shows an alternative embodiment of the shell and tube LDI combustion system in which progressively larger shells are positioned within each other and are used with corresponding groups of tubes.

An alternative embodiment of the combustion system 10 of the present invention could use multiple sets of tubes and/or segregated shell sections (internally partitioned) within the shell and tube LDI 14 to allow for the use of multiple different air/fuel/diluent combinations through multiple different LDI combinations. One example of this kind of embodiment is shown in FIG. 3, in which progressively larger shells, e.g., shells 16A to 16G, positioned within each other are used with corresponding groups of tubes, e.g., 18A to 18G leading to holes 29A to 29G in end plate 22.

Figure 4A:
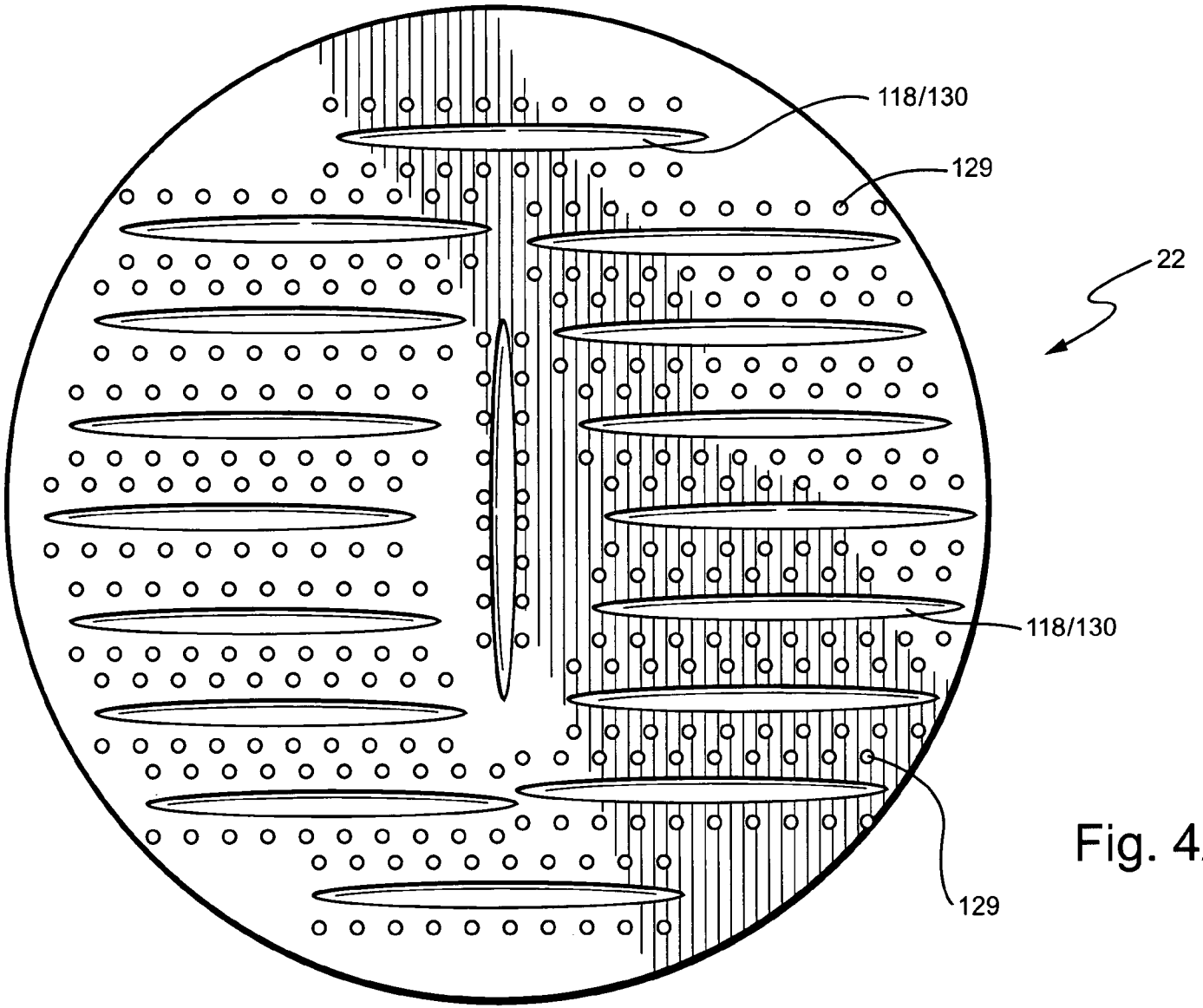
FIG. 4 shows an alternative embodiment of the shell and tube LDI combustion system in which flattened tubes or bars/plates or fin stock is used to form the tubes.
Figure 4C:
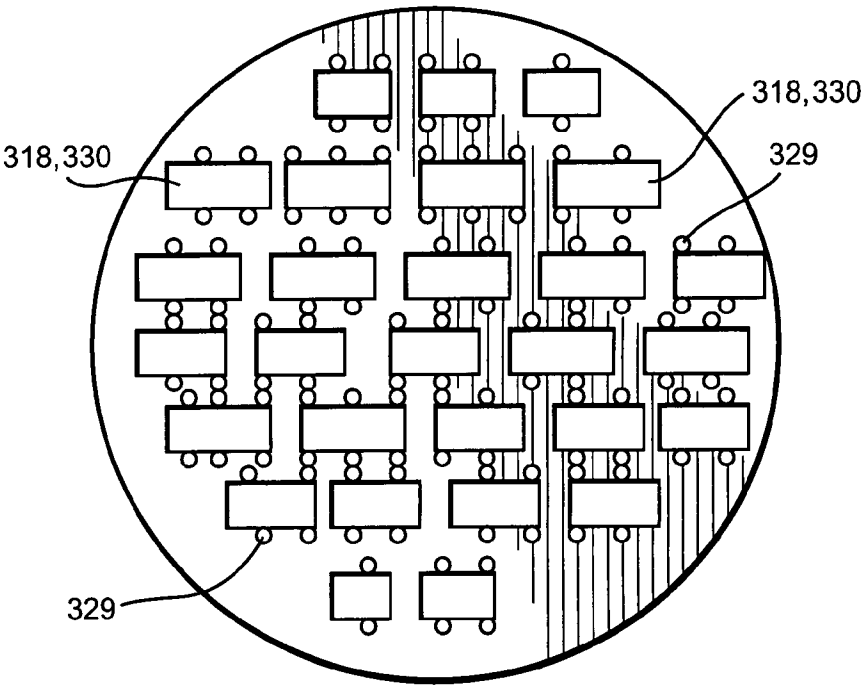
Figure 4B:
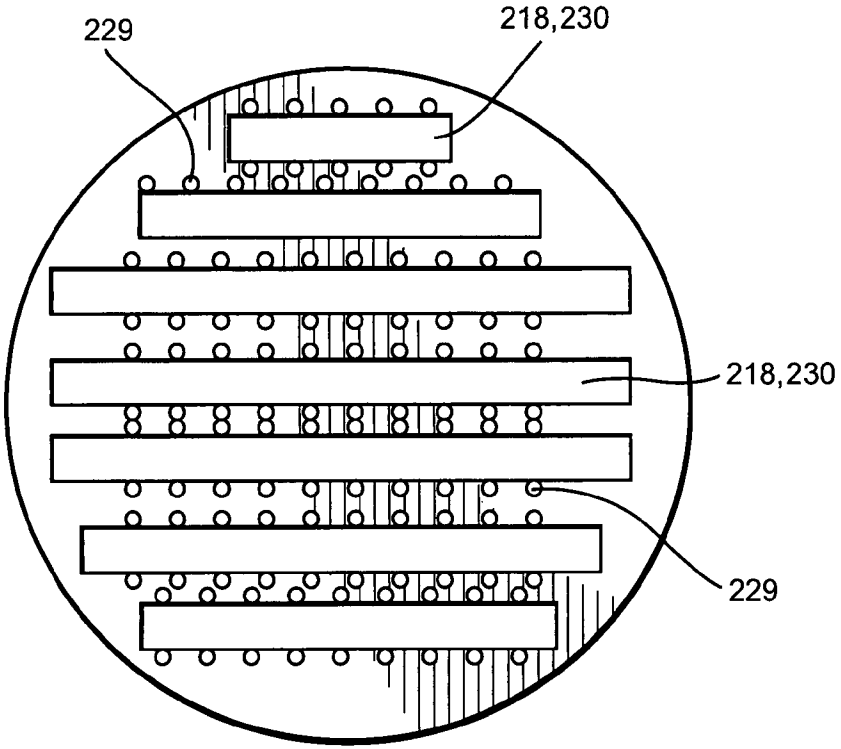

Further embodiments of the combustion system 10 of the present invention could use flattened tubes 118 leading to air holes 130, surrounded by a larger number of fuel holes 129, as shown in FIG. 4A, or bars/plates or fin stock (thin ruffled sheets of metal) 218 or 318 leading to air holes 230 or 330 surrounded by large numbers of fuel holes 229 or 329, as shown in FIGS. 4B and 4C. The bars/plates or fin stock could be brazed together to segregate the different fuel/air/diluent passages. Another embodiment could have progressively larger tubes within each other, with the spaces between the pipes alternately containing air, fuel, diluent, or some combination of each. Yet another embodiment could use a variety of different tube sizes/shapes in any combination to optimize performance.

FIGS. 5A through 5D illustrate yet a further embodiment of the shell and tube LDI combustion system of the present invention. The combustion system 50 shown in FIGS. 5A through 5D includes a combustor 52 and a shell and tube lean direct injector assembly 54 that delivers fuel and air to the combustor 52. The shell and tube LDI 54 is comprised of a shell assembly 56 and a tube assembly 58 positioned within the shell assembly 56.

Figure 5A:
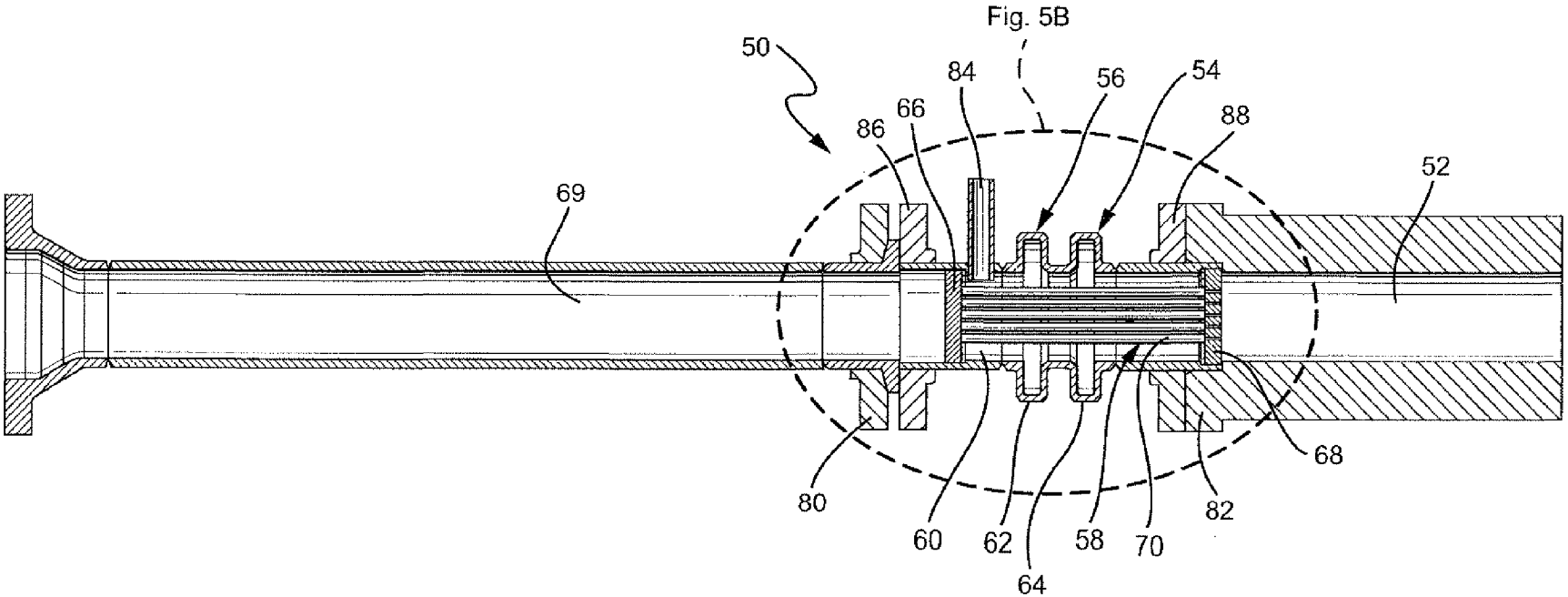
FIGS. 5A through 5D show a further alternative embodiment of the shell and tube LDI combustion system which uses a shell and tube LDI assembly that includes a shell assembly within which a tube assembly is inserted.
Figure 5B:
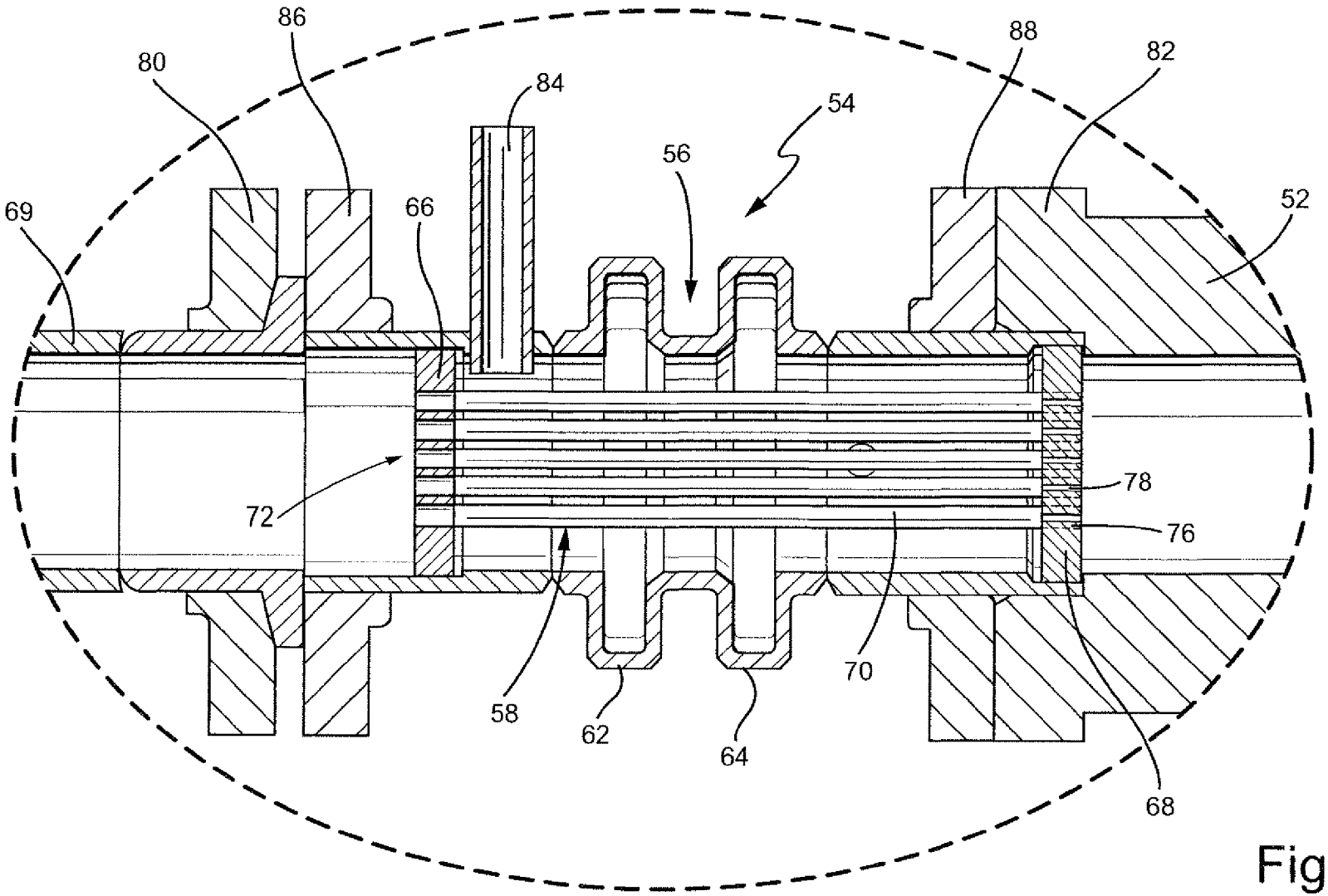
Figure 5D:
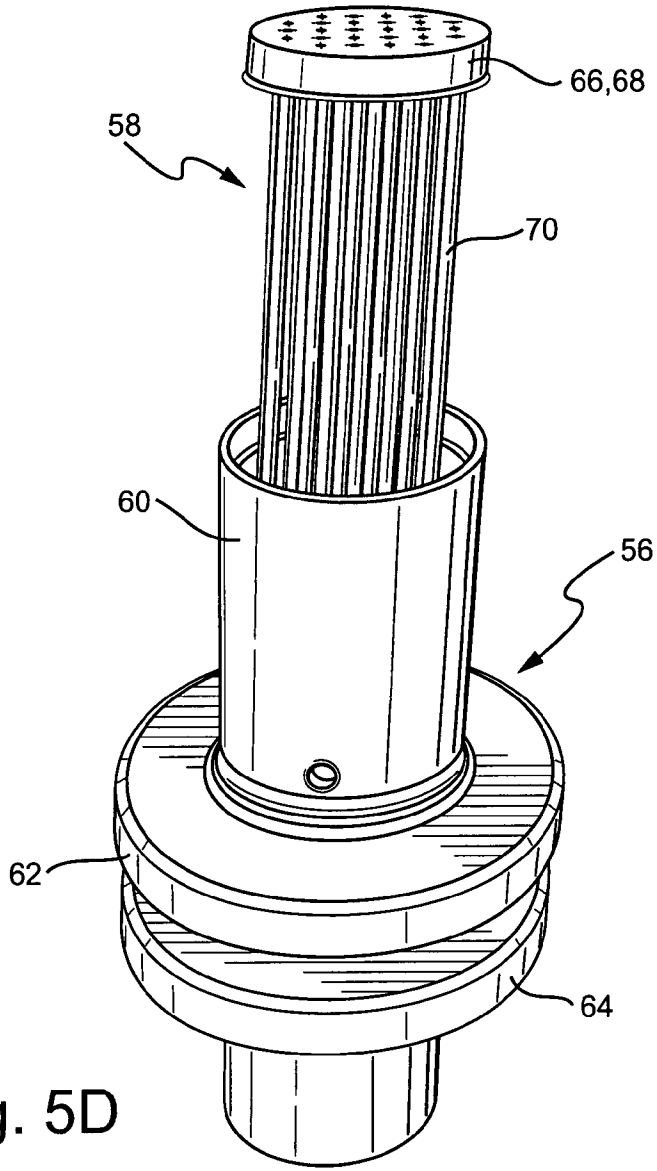
Figure 5C:
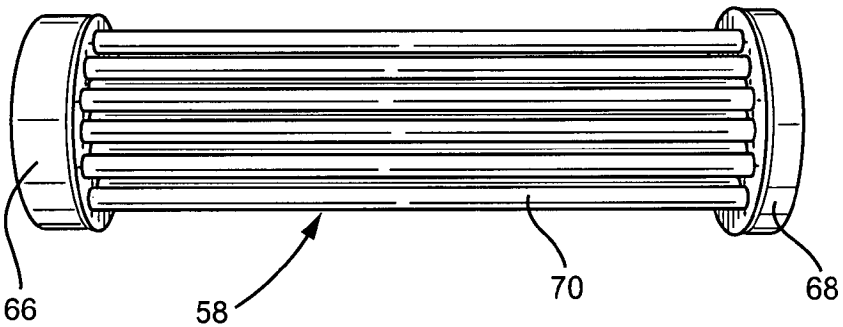

The shell assembly 56 is comprised of a large cylinder 60 with a hollow center within which the tube assembly 58 (FIG. 5C) is inserted, as shown in FIG. 5D, and two flanges 62 and 64 that are welded to the outside of tube 60 to provide strength to tube 60.

The tube assembly 58 is comprised of a first end plate 66, a second end plate 68 and a bundle or plurality of tubes 70 extending between end plates 66 and 68. First end plate 66 has a plurality of holes 72 drilled or otherwise cut into it for receiving air or fuel from an upstream plenum 69. Second end plate 68 has a plurality of holes 76 and 78 for injecting air and fuel into combustor 52. The tubes 70 extend between holes 72 and 76. The configuration of holes 72 and 76 is similar to that of holes 34 and 38 shown in FIG. 2.

Attached to shell assembly 56 are two additional flanges 86 and 88 (FIGS. 5A and 5B) for attaching assembly 56 to corresponding flanges 80 and 82 on upstream plenum 69 and combustor 52, respectively. Shell assembly 56 also includes a fuel inlet 84 through which fuel is pumped into shell assembly 56. The fuel introduced into shell assembly 56 is, in turn, injected into combustor 52 through holes 78 in end plate 68.

The shell and tube LDI combustion system of the present invention provides lower NOx emissions than current MNQC nozzles. Tests have shown NOx levels using the combustion system are less than half those obtained using MNQC nozzles at similar conditions. This could provide a significant emissions advantage and/or reduction in the need for diluents. The combustion system of the present invention also provides better distribution of fuel and air for improved combustion. It allows for scaling down injector sizes to very small sizes or scaling up to large sizes. It can be used in place of current MNQC technology, or in place of current diffusion tips in DLN technology. It can also be used in place of current MNQC nozzles in any sungas engine or in place of diffusion tips in any current DLN combustor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustion system comprising:

a combustor for burning a mixture of air and fuel, the combustor comprising an end plate, and a lean direct injector for directly injecting fuel and air into the combustor, the injector comprising:

a shell including an inlet through which air or fuel is introduced into the shell, the shell having one end connected to the combustor so that air or fuel from the shell passes directly into the combustor end plate for direct injection into the combustor, and a plurality of tubes positioned inside the shell and extending to the combustor so that fuel or air from the plurality of tubes passes directly into the combustor end plate for direct injection into the combustor, the combustor end plate including a first plurality of holes for injecting air or fuel from the shell directly into the combustor, and a second plurality of holes for injecting fuel or air from the plurality of tubes directly into the combustor.

2. The combustion system of claim 1, wherein the shell carries fuel to the combustor and the plurality of tubes carries air to the combustor.

3. The combustion system of claim 1, wherein the shell carries air to the combustor and the plurality of tubes carry fuel to the combustor.

4. The combustion system of claim 1, wherein the shell and the plurality of tubes carry to the combustor, respectively, air and fuel, fuel and air, or a combination of air and fuel and/or a diluent.

5. The combustion system of claim 1, wherein the shell includes a first end plate with a third plurality of holes cut into the first end plate for receiving air or fuel from a plenum connected to the first end plate, and a second end plate connected to the combustor end plate and including a fourth plurality of holes cut into the second end plate for carrying air or fuel directly to the combustor end plate, the plurality of tubes extending between the third and fourth pluralities of holes cut into the first and second end plates.

6. The combustion system of claim 5, wherein the second end plate of the shell includes a fifth plurality of holes cut into the second end plate for carrying air or fuel directly to the combustor end plate.

7. The combustion system of claim 1, wherein the second plurality of holes are cut in line with the tubes through the combustor end plate.

8. The combustion system of claim 1, wherein the first and second plurality of holes are cut at an angle relative to the tubes through the combustor end plate.

9. The combustion system of claim 1, wherein the second plurality of tubes are cut at an angle within the combustor end plate so as to intersect the first plurality of holes so that fuel carried by the second plurality of holes is mixed with air carried by the first plurality of holes.

10. The combustion system of claim 1, wherein the plurality of tubes are brazed or welded to the shell, and wherein the end plate is a cap for the combustor.

11. The combustion system of claim 1, wherein the lean direct injector is comprised of multiple shells and corresponding multiple pluralities of tubes positioned within corresponding shells to allow for the use of multiple air, fuel, and/or diluent combinations in the combustor.

12. The combustion system of claim 1, wherein the tubes are partially flattened.

13. The combustion system of claim 1, wherein the tubes are comprised of bars and plates or fin stock.

14. The combustion system of claim 1, wherein the lean direct injector is comprised of a plurality of progressively larger shells concentrically positioned within each other and wherein each of the plurality of shells has a corresponding group of tubes located within it.

15. A combustion system comprising:

a combustor for burning a mixture of fuel and air, the combustor comprising an end plate, and a lean direct injector for injecting fuel and air directly into the combustor, the injector comprising:

a shell assembly comprised of a cylinder with a hollow center, a first end plate and a second end plate, and a tube assembly inserted into the shell assembly, the tube assembly being comprised of a plurality of tubes extending between the first end plate and the second end plate, the second end plate being connected to the combustor so that only air or fuel from the cylinder and, alternatively, only fuel or air from the plurality of tubes passes directly into the combustor endplate for direct injection into the combustor, the combustor end plate including a first plurality of holes for injecting air or fuel from the shell directly into the combustor, and a separate, second plurality of holes for injecting fuel or air from the plurality of tubes directly into the combustor.

16. The combustion system of claim 15, wherein the tube assembly is further comprised of two flanges welded to the outside of the cylinder to provide strength to the cylinder.

17. The combustion system of claim 15, wherein the first end plate of the tube assembly has a first plurality of holes cut into it for receiving air or fuel from an upstream plenum, and wherein the second plate has second and third pluralities of holes cut into it for passing air and fuel, respectively, to the combustor end plate's first and second pluralities of holes.

18. The combustion system of claim 17, wherein the plurality of tubes extend between the first and second pluralities of holes in the first and second end plates of the tube assembly.

19. The combustion system of claim 18, wherein each of the second plurality of holes in the second end plate for passing air to the combustor end plate's first plurality of holes is larger in size and fewer in number than each of the third plurality of holes in the second end plate for passing fuel to the combustor end plate's second plurality of holes.

20. The combustion system of claim 6, wherein the fourth or fifth plurality of holes in the second end plate for injecting air into the combustor end plate are larger in size and fewer in number than the fourth or fifth plurality of holes in the second end plate for injecting fuel into the combustor end plate.

* * * * *

UNITED STATES PATENT AND TRADEMARK OFFICE

CERTIFICATE OF CORRECTION

PATENT NO. : 8,042,339 B2
APPLICATION NO. : 12/073939
DATED : October 25, 2011
INVENTOR(S) : Lacy et al.

It is certified that error appears in the above-identified patent and that said Letters Patent is hereby corrected as shown below:

Column 1, line 4, after the title, insert the following clause: --This invention was made with Government support under contract number DE-FC26-05NT42643 awarded by the Department Of Energy. The Government has certain rights in this invention.--

Claim 9, column 5, line 35, delete "plurality of tubes are cut" and insert --plurality of holes are cut--

Signed and Sealed this
Sixth Day of December, 2011

David J. Kappos

David J. Kappos
*Director of the United States Patent and Trademark Office*